US010522898B2

(12) United States Patent
Tang et al.

(10) Patent No.: US 10,522,898 B2
(45) Date of Patent: Dec. 31, 2019

(54) INTEGRATION OF MILLIMETER WAVE ANTENNAS IN REDUCED FORM FACTOR PLATFORMS

(71) Applicant: INTEL CORPORATION, Santa Clara, CA (US)

(72) Inventors: Min Keen Tang, Taman Sri Nibong (MY); Ana M. Yepes, Hillsboro, OR (US); Yaniv Michaeli, Holon (IL); Menashe Soffer, Katzir (IL)

(73) Assignee: INTEL CORPORATION, Santa Clara, CA (US)

( * ) Notice: Subject to any disclaimer, the term of this patent is extended or adjusted under 35 U.S.C. 154(b) by 0 days.

(21) Appl. No.: 15/756,923

(22) PCT Filed: Aug. 30, 2016

(86) PCT No.: PCT/US2016/049482
§ 371 (c)(1),
(2) Date: Mar. 1, 2018

(87) PCT Pub. No.: WO2017/058446
PCT Pub. Date: Apr. 6, 2017

(65) Prior Publication Data

US 2019/0058240 A1 Feb. 21, 2019

(30) Foreign Application Priority Data

Oct. 1, 2015 (MY) ..... PI2015002485

(51) Int. Cl.
*H01Q 1/38* (2006.01)
*H01Q 1/22* (2006.01)
(Continued)

(52) U.S. Cl.
CPC ..... *H01Q 1/2266* (2013.01); *H01Q 1/48* (2013.01); *H01Q 9/0407* (2013.01); *H01Q 21/28* (2013.01)

(58) Field of Classification Search
CPC ..... H01Q 1/2265; H01Q 1/48; H01Q 1/2266; H01Q 1/38
(Continued)

(56) References Cited

U.S. PATENT DOCUMENTS 6,072,434 A 6/2000 Papatheodorou
6,219,002 B1 4/2001 Lim
(Continued)

FOREIGN PATENT DOCUMENTS

WO 2017-058446 A1 4/2017

OTHER PUBLICATIONS

International Search Report and Written Opinion issued in PCT Application No. PCT/US2016/049482, dated Dec. 2, 2016, 11 pages.
(Continued)

*Primary Examiner* — Peguy Jean Pierre
(74) *Attorney, Agent, or Firm* — Grossman, Tucker, Perreault & Pfleger, PLLC

(57) ABSTRACT

Generally, this disclosure provides systems, devices and methods for integration of millimeter wave antennas in platforms with reduced form factors while maintaining or improving antenna gain. An antenna assembly may include a first planar substrate; a ground plane disposed on the first planar substrate; a second planar substrate disposed on the ground plane; and an antenna radiation element disposed on the second planar substrate. The antenna radiation element may be configured to transmit a signal in the millimeter wave frequency region. The assembly may also include a via to provide a conductive path for the signal from a microstrip
(Continued)

feed line, beneath the first planar substrate, to the antenna radiation element. The assembly may further include a dielectric layer disposed on the antenna radiation element to provide increased antenna gain under conditions of reduced air gap between the antenna radiation element and a structural element of an enclosing platform.

20 Claims, 10 Drawing Sheets

(51) Int. Cl.
*H01Q 1/48* (2006.01)
*H01Q 9/04* (2006.01)
*H01Q 21/28* (2006.01)

(58) Field of Classification Search
USPC ..... 343/846
See application file for complete search history.

(56) References Cited

U.S. PATENT DOCUMENTS

| | | | | |
|---|---|---|---|---|
| 8,860,607 | B2 * | 10/2014 | Shamim | G01S 7/03 342/175 |
| 9,584,231 | B2 * | 2/2017 | Xu | H01Q 1/246 |
| 2011/0057853 | A1 | 3/2011 | Kim et al. | |
| 2015/0194724 | A1 | 7/2015 | Yepes et al. | |
| 2017/0222316 | A1 * | 8/2017 | Mizunuma | H01Q 1/38 |
| 2019/0074592 | A1 * | 3/2019 | Celik | H01Q 9/0407 |

OTHER PUBLICATIONS

International Preliminary Report on Patentability and Written Opinion issued in PCT Application No. PCT/US2016/049482, dated Apr. 12, 2018, 10 pages.

* cited by examiner

400

500

600

700

800

INTEGRATION OF MILLIMETER WAVE ANTENNAS IN REDUCED FORM FACTOR PLATFORMS

CROSS-REFERENCE TO RELATED APPLICATIONS

This present application is a National Phase Application Filed Under 35 U.S.C. 371 claiming priority to PCT/US2016/049482 filed Aug. 30, 2016, which in turns claims priority to Malaysian Patent Application No. PI2015002485, filed Oct. 1, 2015 the entire disclosures of which are incorporated herein by reference.

FIELD

The present disclosure relates to millimeter wave antennas, and more particularly, to the integration of millimeter wave antennas in reduced size form factor platforms.

BACKGROUND

Electronic devices or platforms, such as laptops, notebooks, netbooks, personal digital assistants (PDAs), smartphones and mobile phones, for example, increasingly tend to include a variety of wireless communication capabilities. The wireless communication systems used by these devices are expanding into the higher frequency ranges of the communication spectrum, such as, for example, the millimeter wave region and, in particular, the unlicensed 6-9 GHz wide spectral band at 60 GHz, often referred to as WiGig. This expansion to higher frequencies is driven in part by the requirement for increased data rate communications in applications that can reduce or eliminate input/output cabling requirements and/or provide improved peer to peer connectivity. WiGig technology can provide relatively short range wireless communication that may be used, for example, in a wireless docking station for a mobile platform.

Modern mobile platforms, however, are increasingly being designed into smaller form factors that are more convenient to carry and more aesthetically pleasing to the user. These designs are sometimes referred to as "ultra-thin" and may include, for example, thinner and smaller clamshell, slider or detachable designs. Integration of antennas compatible with WiGig technology, however, presents challenges as the form factor size decreases. Current WiGig antennas generally require an air gap or layer of non-conductive material between the antenna and the platform casing to reduce degradation of the 60 GHz signal radiating through the casing. These antennas will not fit in the newer, smaller form factor platforms that are being developed.

BRIEF DESCRIPTION OF THE DRAWINGS

Features and advantages of embodiments of the claimed subject matter will become apparent as the following Detailed Description proceeds, and upon reference to the Drawings, wherein like numerals depict like parts, and in which:

Although the following Detailed Description will proceed with reference being made to illustrative embodiments, many alternatives, modifications, and variations thereof will be apparent to those skilled in the art.

DETAILED DESCRIPTION

Generally, this disclosure provides systems, devices and methods for integration of millimeter wave antennas in platforms with reduced size form factors while maintaining or improving antenna gain. The antennas may be configured as printed millimeter wave antennas, such as, for example, patch antennas, which generally have relatively low profiles. In particular, the antennas may operate in the unlicensed 60 GHz region associated with the use of wireless local area network (WLAN) communication systems and other relatively short range wireless communications. The reduced form factor platforms may sometimes be referred to as "ultra-thin" platforms, for example in conjunction with smartphones and laptops. In some embodiments, a relatively thin dielectric layer is applied over the antenna radiation element, providing for an increased antenna gain without requiring an air gap between the antenna and adjacent platform structures such as the casing or bezel. This allows for the deployment of the antenna in the more constricted spaces of these "ultra-thin" platforms.

Figure 1:
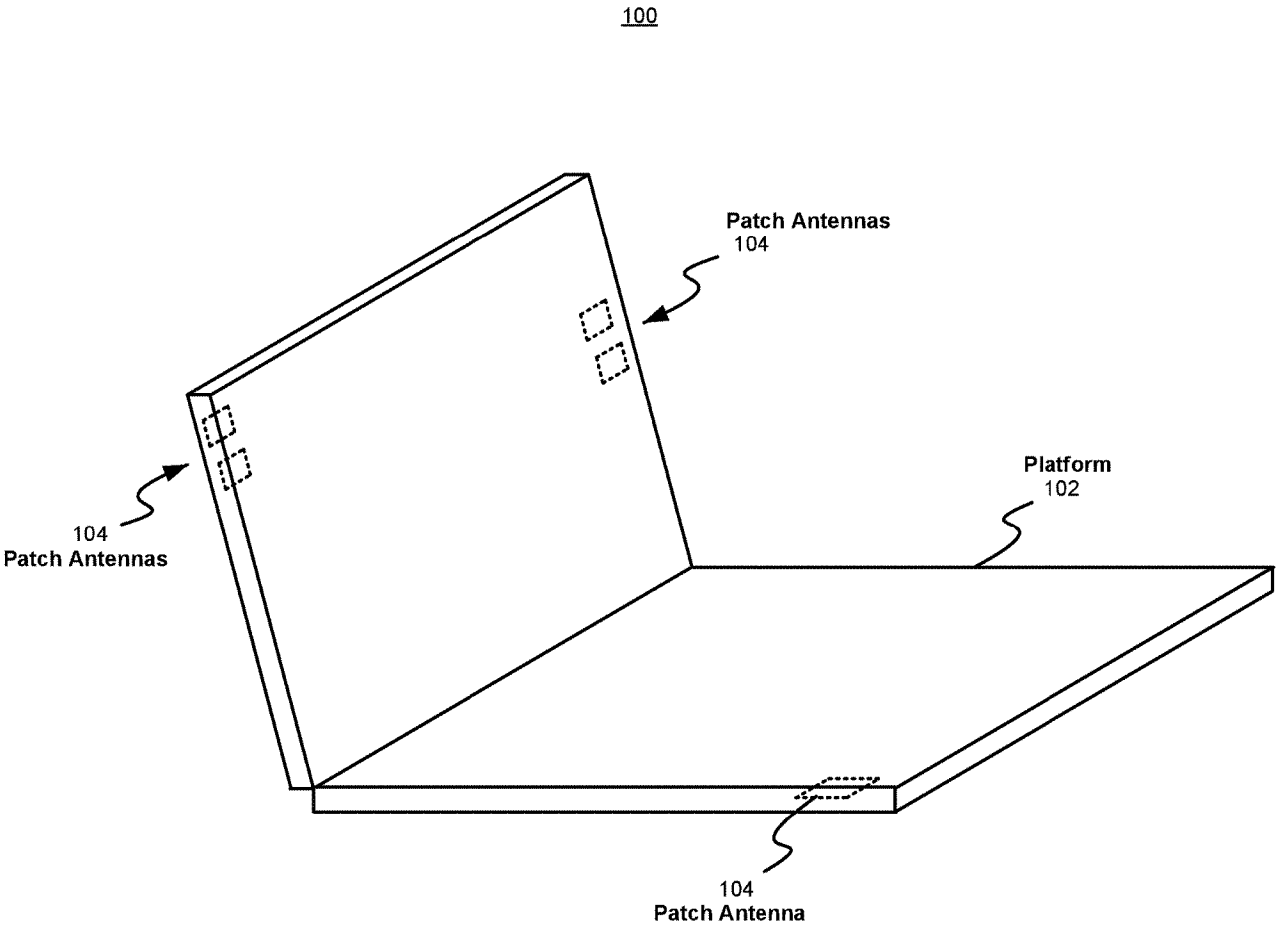
FIG. 1 illustrates a top level diagram of an example embodiment in a platform, consistent with the present disclosure.

FIG. 1 illustrates a top level diagram 100 of an example embodiment consistent with the present disclosure. A sample platform 102 is illustrated in the form of a laptop, although other platforms are possible including, for example, smartphones, tablets, personal digital assistants and the like. One or more printed millimeter wave antennas (or patch antennas) 104 may be installed at various locations within the platform, as shown, to provide wireless communication capabilities.

Figure 2:
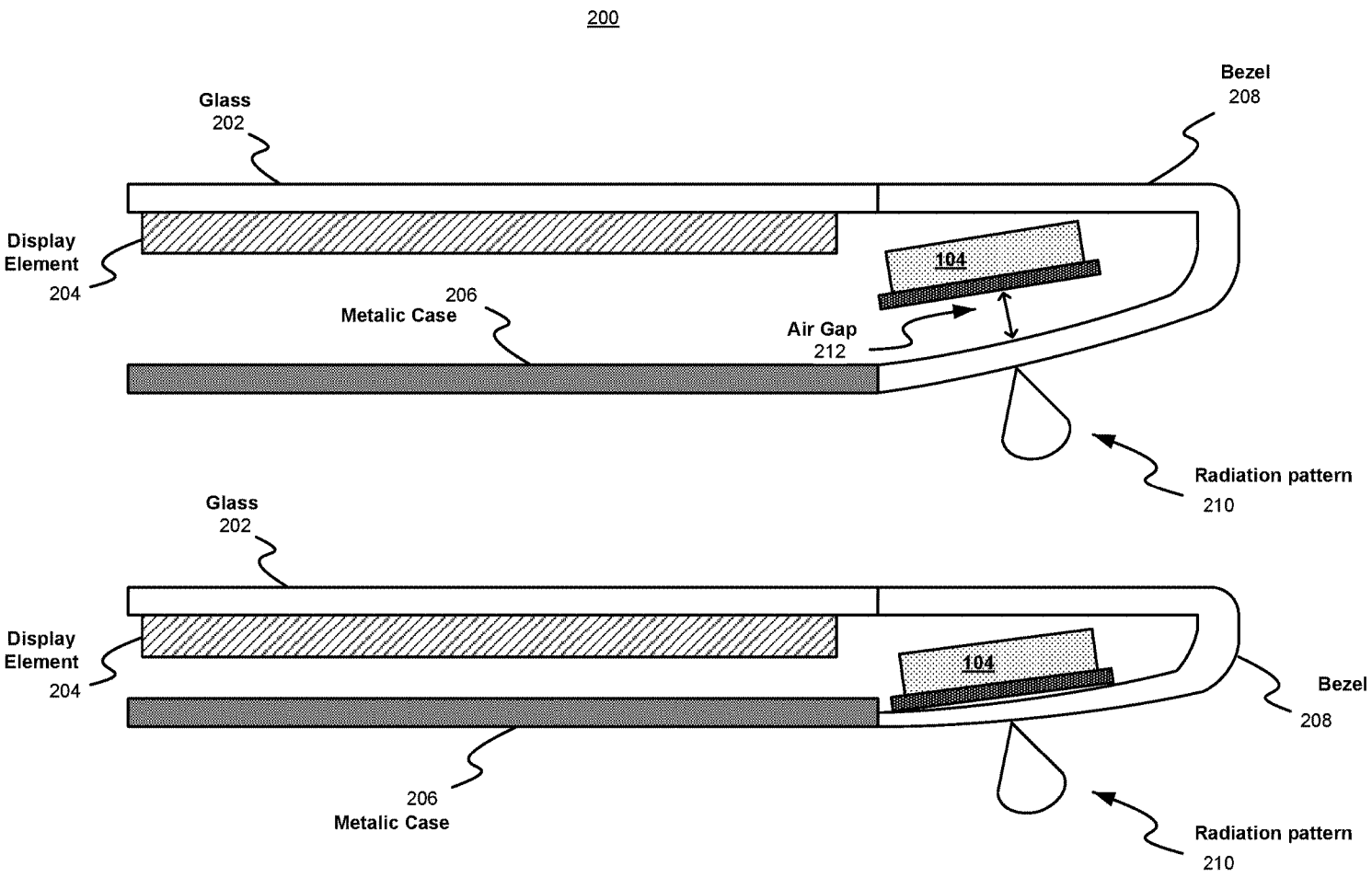
FIG. 2 illustrates a cross sectional diagram of an example embodiment in a platform, consistent with the present disclosure.

FIG. 2 illustrates a cross sectional diagram 200 of an example embodiment in a platform, consistent with the present disclosure. In this example, the antenna 104 is shown to be installed in the top bezel portion 208 of the laptop screen (or casing) which may be contoured into a tapering shape. The platform screen is shown to include various components, such as, for example, a glass front 202, a display element 204 beneath the glass, and a metallic case structure 206, although other suitable materials may be used.

In the top example, the casing is wide enough to permit gap 212 between the antenna 104 and the bezel 208. The gap may be an air gap or some other non-conductive material with similar properties to air. The air gap may be about 0.5 mm, which is generally large enough to provide a sufficient antenna gain of about 5 decibels (dB) to the radiation pattern 210, despite the interfering presence of the bezel 208.

In the bottom example, however, the width of the casing has been reduced to provide an "ultra-thin" form factor. In this case, there is no longer room for the air gap 212 so that it must either be eliminated or significantly reduced (e.g., 0.2 mm or less). If the antenna 104 is placed directly against the bezel or casing material, an unacceptable degradation of the radiation pattern 210 (and associated reflection coefficient) may occur which can result in loss of the wireless connection. Embodiments of the present disclosure, described below, provide a solution to reduce the dependence of the antenna performance on the presence of an air gap 212.

Figure 3:
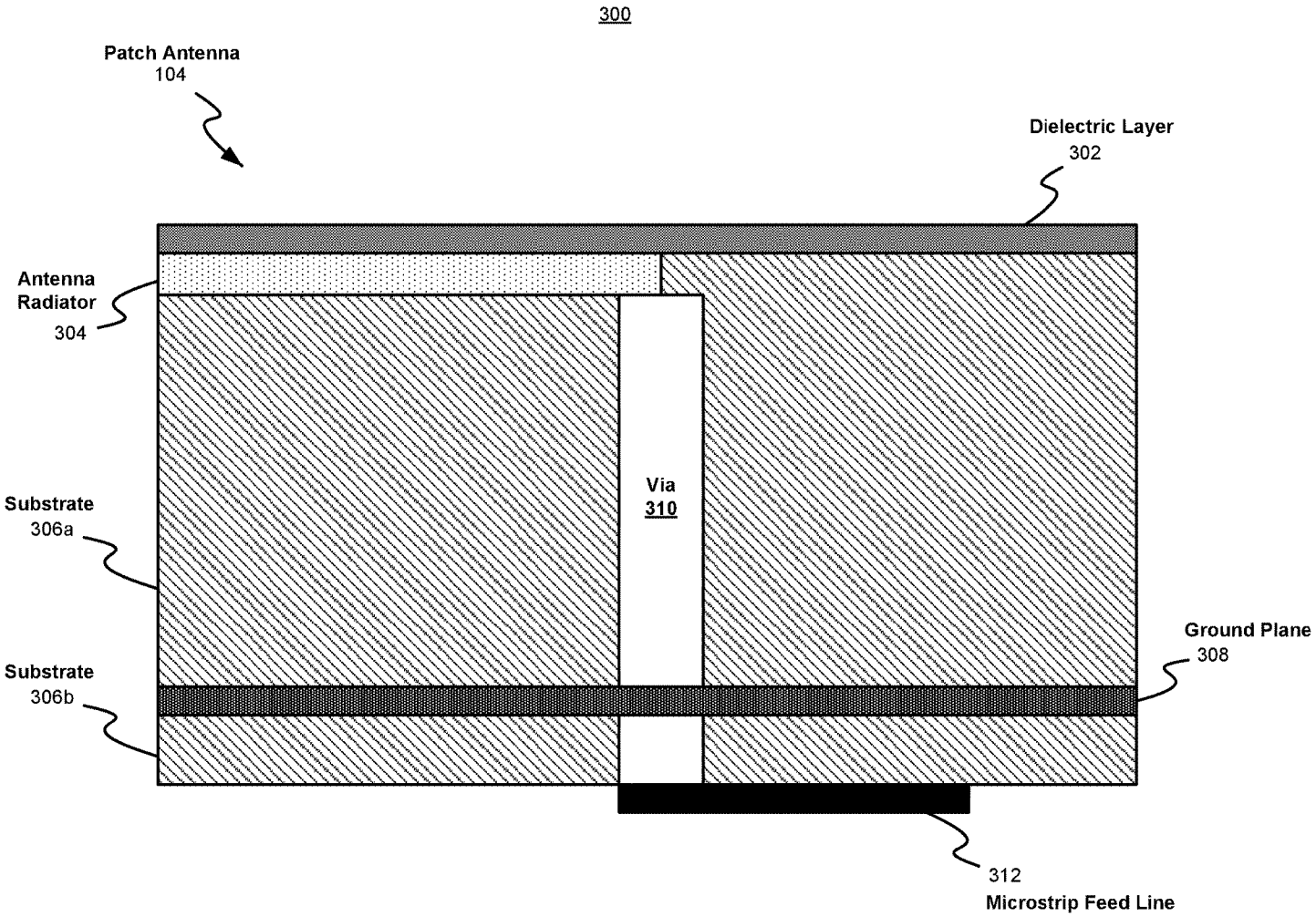
FIG. 3 illustrates a cross sectional diagram of an example embodiment consistent with the present disclosure.

FIG. 3 illustrates a cross sectional diagram 300 of an example embodiment consistent with the present disclosure. The millimeter wave antenna assembly (or patch antenna) 104 is shown in cross section to include a number of layers and components. A planar substrate layer 306 is configured to provide both mechanical structure for the antenna and a dielectric medium. The substrate 306 may comprise a semiconductor material having a dielectric constant that may be selected based on the frequency of the transmitted signal, the desired radiation pattern and/or the geometry of the antenna assembly. A ground plane 308 may be embedded in the substrate 306. In some embodiments, a first planar substrate level 306*b* and a second parallel planar substrate level 306*a* may be disposed above and below the ground plane 308 for efficiency of fabrication. The ground plane 308 is parallel to the substrate layers 306*a*, 306*b*.

An antenna radiator element 304 is disposed on top of the substrate layer 306*a* and configured to transmit a signal in the millimeter wave frequency region.

A microstrip feed line 312 is configured to provide an electrical coupling to the antenna assembly 104 through which the signal to be transmitted is supplied, for example from an external source in the platform.

A via 310 is configured to provide a conductive path for the signal from the microstrip feed line 312, beneath the first planar substrate, to the antenna radiation element 304. In some embodiments, the via 310 may run substantially perpendicular (or normal) to the planes of the substrate and antenna radiator.

A dielectric layer 302 is disposed on top of the antenna radiator element 304 and the substrate layer 306. The dielectric layer 302 may be configured to provide increased antenna gain in conditions where the air gap, between the antenna radiation element and other structural elements of the enclosing platform, is reduced to conserve space. Properties of the dielectric layer 302, including thickness and dielectric constant, may be selected to provide the desired antenna gain based on the frequency of the signal, the required air gap distance and/or other considerations.

In some embodiments, the thickness of the dielectric layer 302 may be in the range of 7 micrometers (um) to 90 um, and the dielectric constant may be chosen to be in the range of 1 to 8. The reduced air gap may be in the range of zero to 0.2 millimeters (mm), and the frequency of the transmitted signal may be in the range of 56 gigahertz (GHz) to 64 GHz. Combinations of these parameters may result in an antenna gain in the range of 3.5 decibels (dB) to 5 dB.

In some embodiments, the dielectric layer 302 may be applied as a thin layer solder mask or as an adhesive epoxy. In some embodiments, the dielectric layer 302 may be configured as a double sided tape with suitable dielectric properties that can be added between the antenna and the casing or bezel. In some embodiments, the dielectric layer 302 may be implemented by obtaining an antenna package from a manufacturer with increased layers, where the antenna radiator element is realized on an inner metal layer and the metal on the top layer covering the antenna assembly is removed during final fabrication such that only the dielectric layer remains. The package design can be adjusted accordingly in a symmetric stack, or an asymmetric stack may be used such that the only change involves adding a layer.

It will be understood that the patch type antenna illustrated in the examples herein is just one example of a millimeter wave antenna configured for radiation in the broadside direction (i.e., normal to the surface). The concepts and features disclosed herein, however, may be readily applied to other antenna types, and also to antenna arrays (arrays of multiple antenna elements, e.g. multiple patches). Actual gain values, of course, may vary depending on the antenna being used, but the addition of the dielectric layer improves the gain when the antenna is in close proximity to the system chassis (casing). Furthermore, the examples presented herein, are based on an antenna operating in the WiGig frequency band (57 GHz-66 GHz with up to 9 GHz of bandwidth), however the embodiments of the present disclosure may be applied to antennas operating in other millimeter wave frequencies as well.

Figure 4:
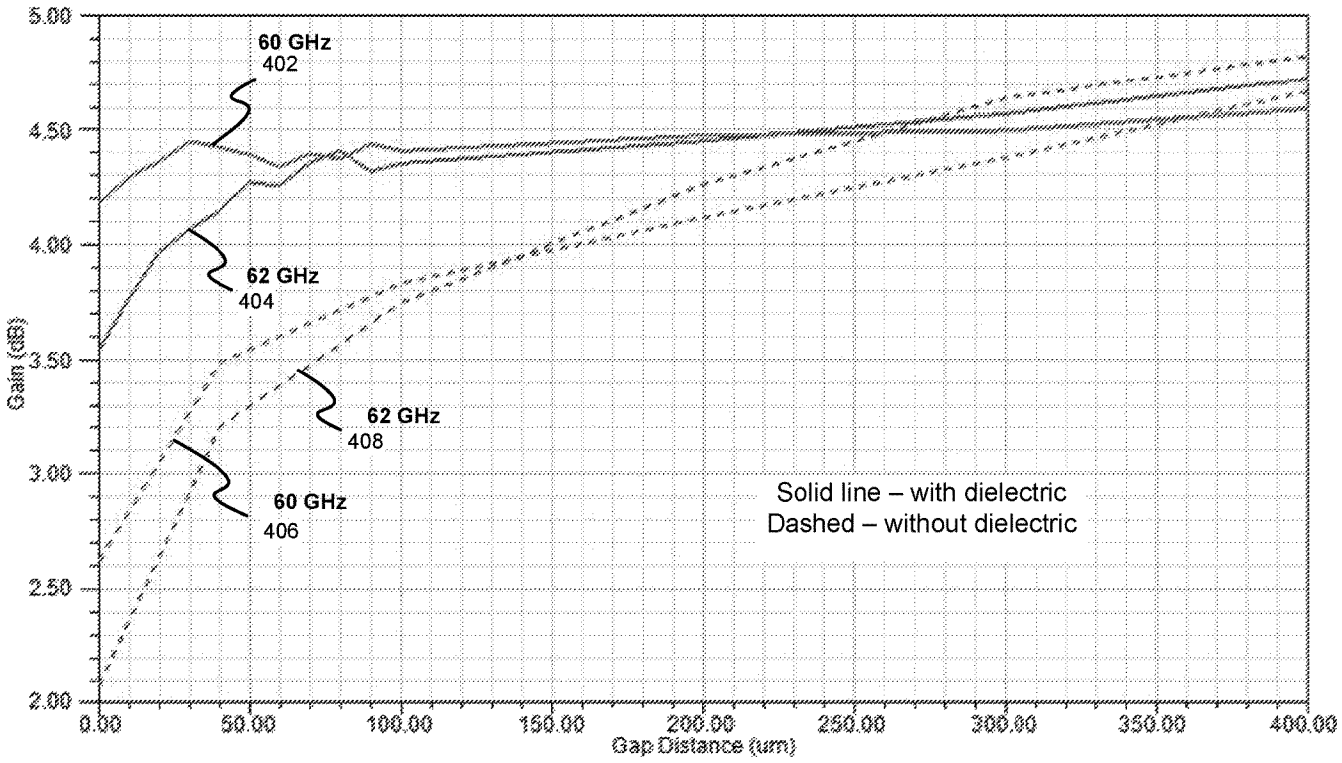
FIG. 4 illustrates a plot of performance of one example embodiment consistent with the present disclosure.

FIG. 4 illustrates a plot of performance 400 of one example embodiment consistent with the present disclosure. Antenna gain (in dB) is shown as a function of gap distance (in um) at two different transmission frequencies: 60 GHz and 62 GHz. The solid lines 402, 404 illustrate the performance of an antenna embodiment comprising the dielectric layer 302 disposed on top of the antenna radiator 304. The dashed lines 406, 408 illustrate, for comparison, the performance of an otherwise comparable antenna without the dielectric layer 302. As can be seen, the antenna gain is improved (increased) with the addition of the dielectric layer 302. These results, along with additional examples at 58 GHz and 64 GHz, are summarized in Table 1, below, for the various gap distances and frequencies.

TABLE 1

Example Gain Improvement (in dB with/without additional dielectric layer)

| Distance (um) | 58 GHz | 60 GHz | 62 GHz | 64 GHz |
|---|---|---|---|---|
| 0 | 4.12/2.81 | 4.18/2.62 | 3.54/2.07 | 2.89/1.50 |
| 100 | 3.93/3.34 | 4.41/3.83 | 4.35/3.75 | 4.08/3.40 |
| 200 | 3.83/3.38 | 4.47/4.12 | 4.45/4.26 | 4.26/3.95 |
| 300 | 3.95/3.57 | 4.49/4.38 | 4.57/4.64 | 4.35/4.41 |
| 400 | 3.96/3.77 | 4.59/4.67 | 4.72/4.82 | 4.48/4.61 |
| 500 | 4.04/3.93 | 4.69/4.82 | 4.82/5.06 | 4.54/4.70 |

Figure 5:
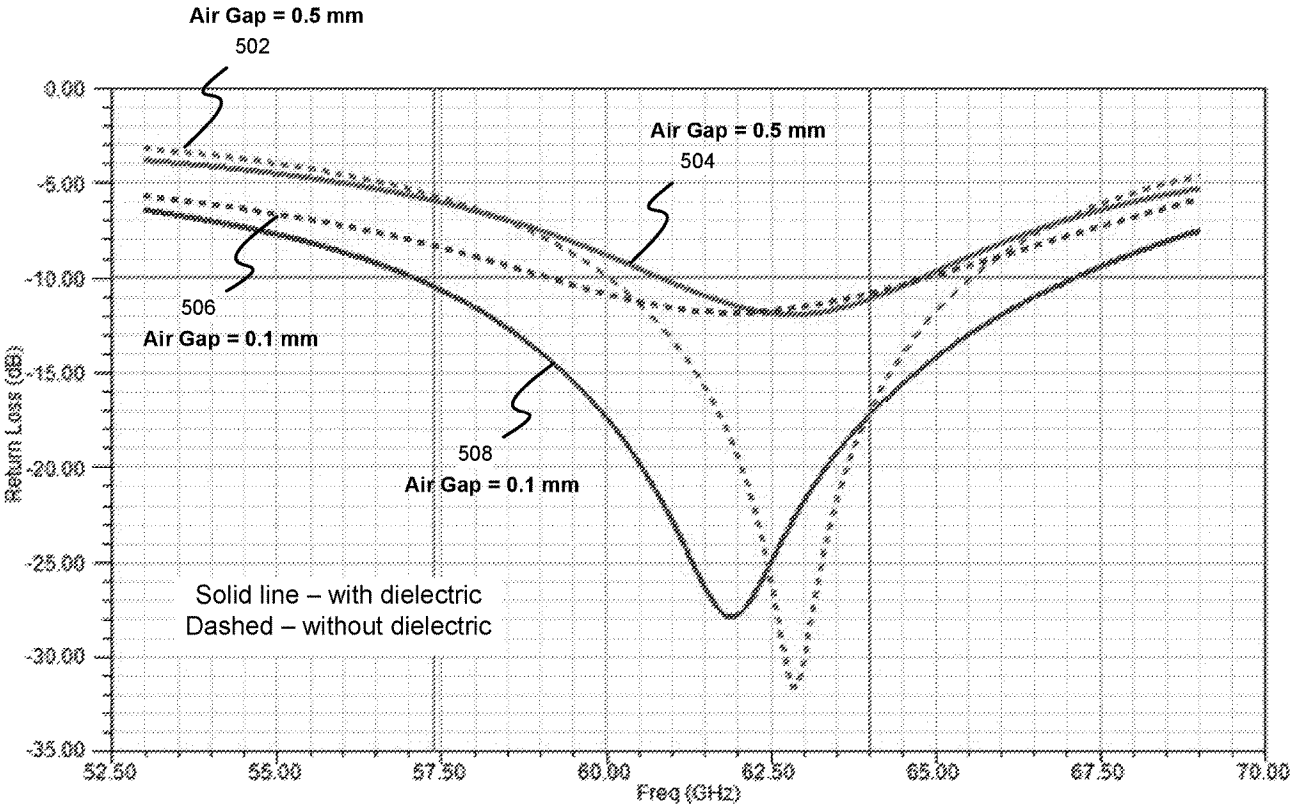
FIG. 5 illustrates a plot of performance of another example embodiment consistent with the present disclosure.

FIG. 5 illustrates a plot of performance 500 of another example embodiment consistent with the present disclosure. Antenna return loss (in dB) is shown as a function of transmission frequency, for 2 different air gap values: 0.1 mm and 0.5 mm. The solid lines 504, 508 illustrate the performance of an antenna embodiment comprising the dielectric layer 302 disposed on top of the antenna radiator 304. The dashed lines 502, 506 illustrate, for comparison, the performance of an otherwise comparable antenna without the dielectric layer 302. As can be seen, comparing 506 and 508, the return loss is improved for the smaller air gap (0.1 mm) with the addition of the dielectric layer 302.

Figure 6:
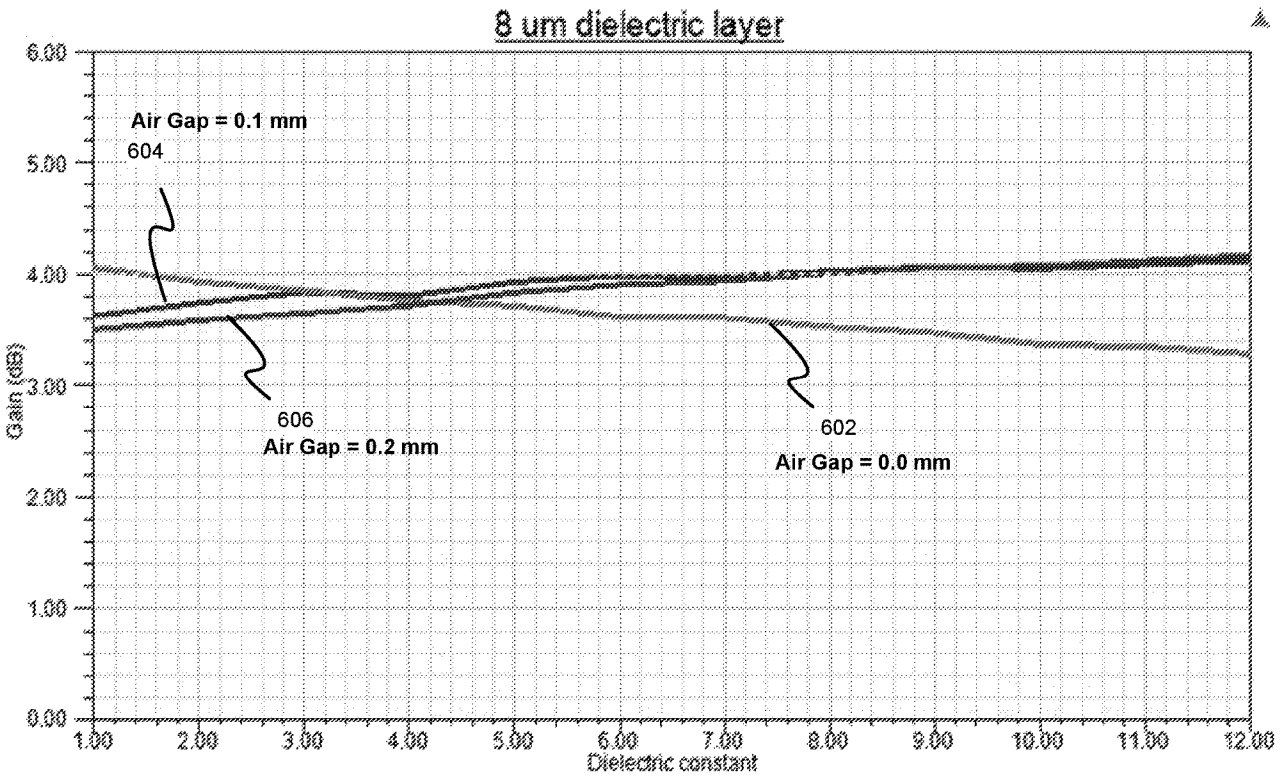
FIG. 6 illustrates a plot of performance of another example embodiment consistent with the present disclosure.
Figure 7:
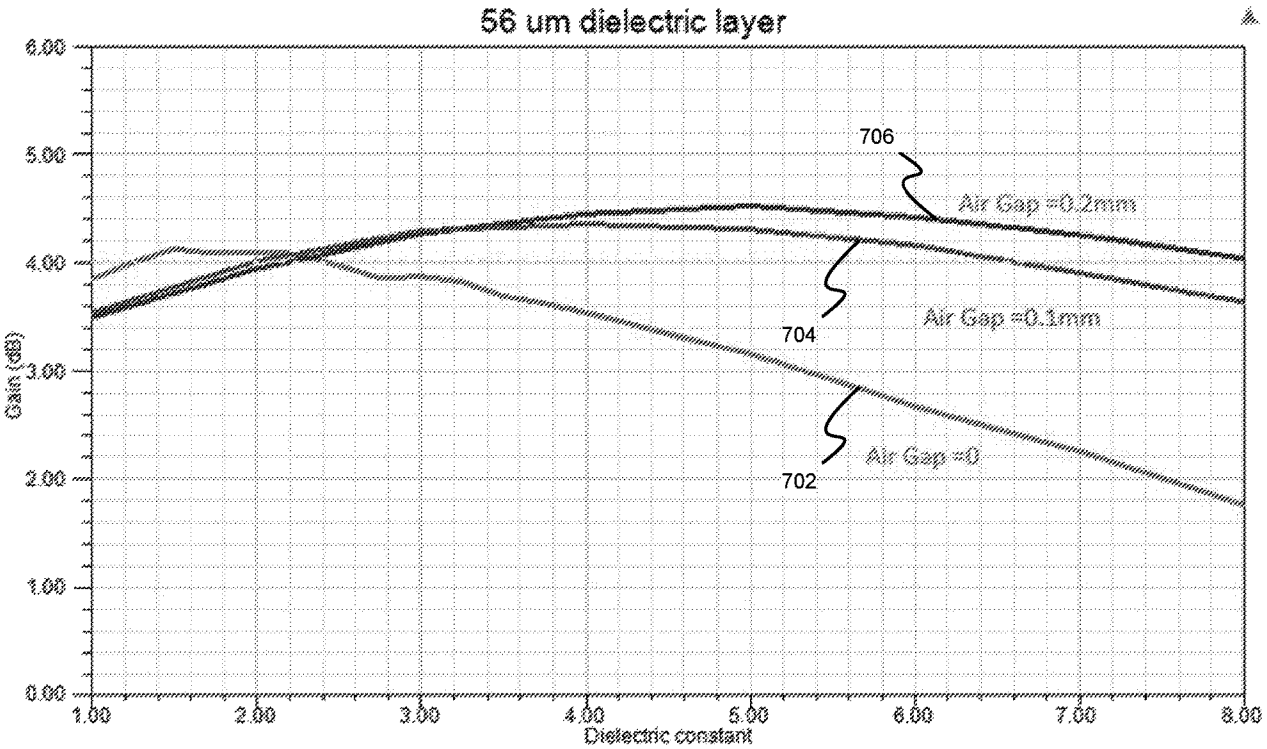
FIG. 7 illustrates a plot of performance of another example embodiment consistent with the present disclosure.
Figure 8:
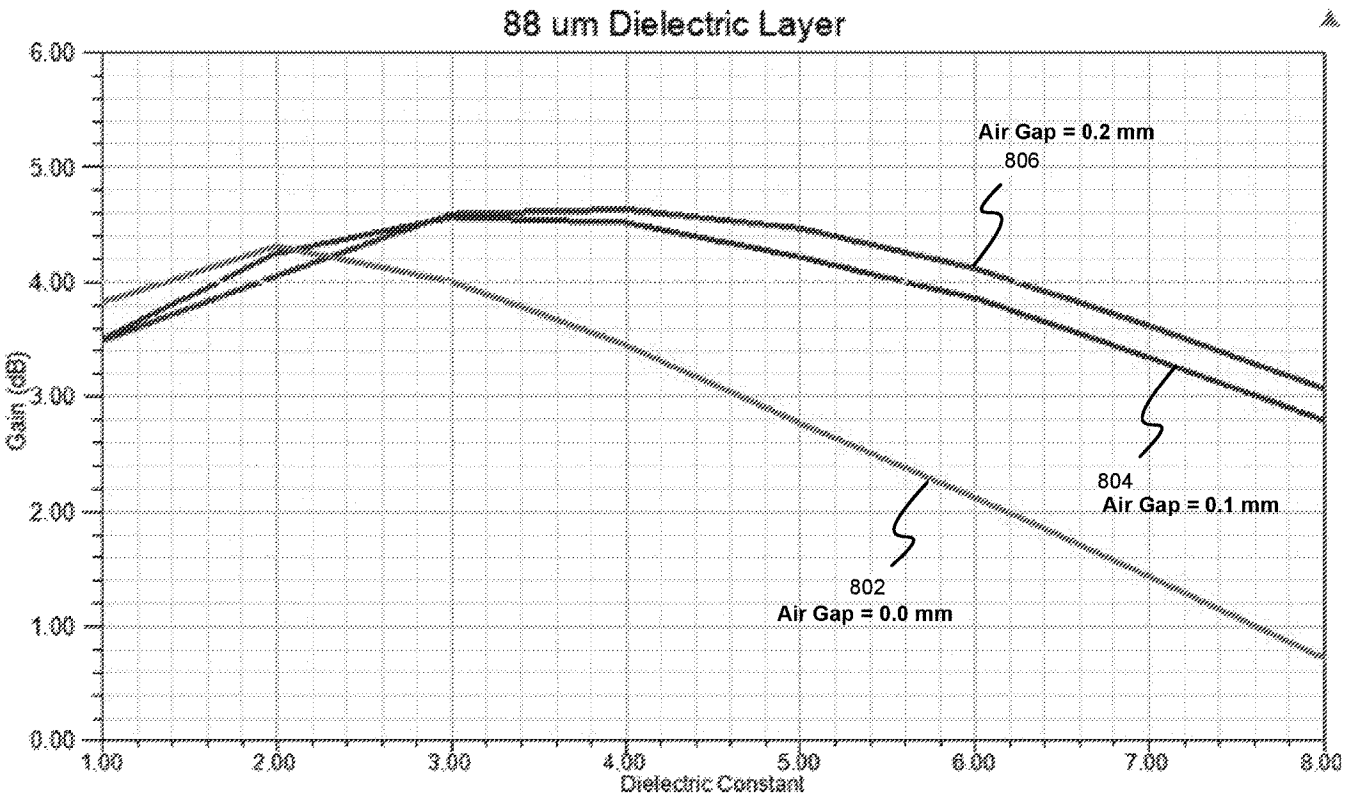
FIG. 8 illustrates a plot of performance of another example embodiment consistent with the present disclosure.

FIGS. 6-8 compare the effects of variations in the choice of thickness of the dielectric layer 302.

FIG. 6 illustrates a plot of performance 600 of another example embodiment consistent with the present disclosure. For this plot, the thickness of dielectric layer 302 was selected as 8 um. Antenna gain (in dB) is shown as a function of the dielectric constant of dielectric layer 302, for 3 different air gap values: 0.0 mm 602, 0.1 mm 604, and 0.2 mm 606.

FIG. 7 illustrates a plot of performance 700 of another example embodiment consistent with the present disclosure. For this plot, the thickness of dielectric layer 302 was selected as 56 um. Antenna gain (in dB) is shown as a function of the dielectric constant of dielectric layer 302, for 3 different air gap values: 0.0 mm 702, 0.1 mm 704, and 0.2 mm 706.

FIG. 8 illustrates a plot of performance 800 of another example embodiment consistent with the present disclosure. For this plot, the thickness of dielectric layer 302 was selected as 88 um. Antenna gain (in dB) is shown as a function of the dielectric constant of dielectric layer 302, for 3 different air gap values: 0.0 mm 802, 0.1 mm 804, and 0.2 mm 806. A comparison for FIGS. 6 through 8 reveals that a thicker dielectric layer 302 can improve antenna gain and that the dielectric layer is more effective for smaller air gaps, which is consistent with the goals of fitting the antenna in smaller spaces within the platform. These plots also allow for the selection of a dielectric constant that best matches a particular geometric configuration.

Figure 9:
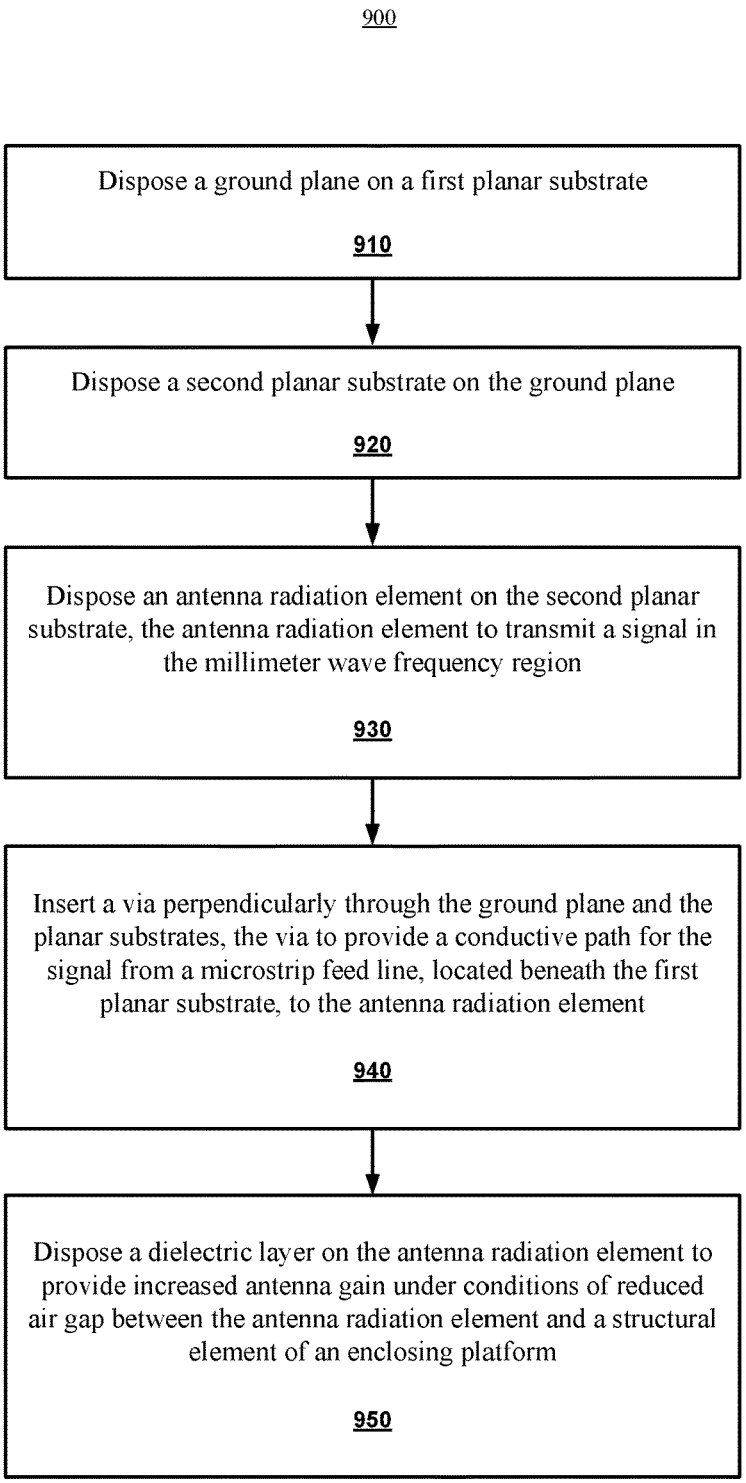
FIG. 9 illustrates a flowchart of operations of another example embodiment consistent with the present disclosure.

FIG. 9 illustrates a flowchart of operations 900 of another example embodiment consistent with the present disclosure. The operations provide a method for fabrication of a millimeter wave antenna assembly. At operation 910, a ground plane is disposed on a first planar substrate. At operation 920, a second planar substrate is disposed on the ground plane. At operation 930, an antenna radiation element is disposed on the second planar substrate. The antenna radiation element is configured to transmit a signal in the millimeter wave frequency region. At operation 940, a via is inserted perpendicularly through the ground plane and the planar substrates. The via is configured to provide a conductive path for the signal from a microstrip feed line, located beneath the first planar substrate, to the antenna radiation element. At operation 950, a dielectric layer is disposed on the antenna radiation element to provide increased antenna gain under conditions of reduced air gap between the antenna radiation element and a structural element of an enclosing platform.

Figure 10:
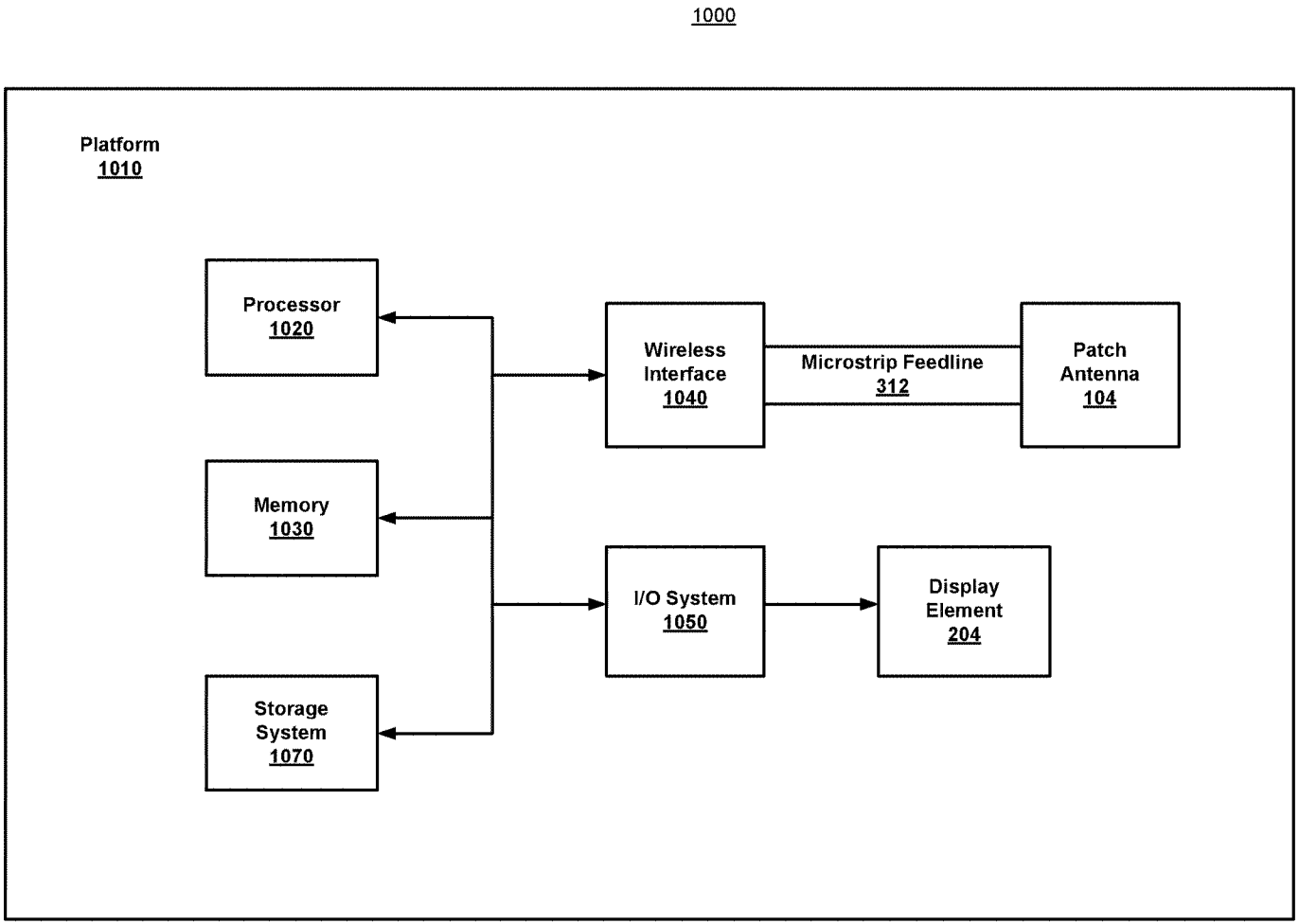
FIG. 10 illustrates a system diagram of a platform of another example embodiment consistent with the present disclosure.

FIG. 10 illustrates a system diagram 1000 of one example embodiment consistent with the present disclosure. The system 1000 may be a platform 1010 hosting a communication and/or computing device such as, for example, a smart phone, smart tablet, personal digital assistant (PDA), mobile Internet device (MID), convertible tablet, notebook or laptop computer, workstation or desktop computer.

The system 1000 is shown to include one or more processors 1020 and memory 1030. In some embodiments, the processors 1020 may be implemented as any number of processor cores. The processor (or processor cores) may be any type of processor, such as, for example, a microprocessor, an embedded processor, a digital signal processor (DSP), a graphics processor (GPU), a network processor, a field programmable gate array or other device configured to execute code. The processors may be multithreaded cores in that they may include more than one hardware thread context (or "logical processor") per core. The memory 1030 may be coupled to the processors. The memory 1030 may be any of a wide variety of memories (including various layers of memory hierarchy and/or memory caches) as are known or otherwise available to those of skill in the art. It will be appreciated that the processors and memory may be configured to store, host and/or execute one or more operating systems, user applications or other software. The applications may include, but not be limited to, for example, any type of computation, communication, data management, data storage and/or user interface task. In some embodiments, these applications may employ or interact with any other components of the platform 1010.

System 1000 is also shown to include a wireless communications interface circuit 1040 which may include wireless communication capabilities, such as, for example, cellular communications, Wireless Fidelity (WiFi), Bluetooth®, and/or Near Field Communication (NFC). The wireless communications may conform to or otherwise be compatible with any existing or yet to be developed communication standards including past, current and future version of Bluetooth®, Wi-Fi and mobile phone communication standards. The wireless communications interface circuit 1040 may be coupled, for example through a microstrip feedline 312, to one or more millimeter wave antennas 104 which may be configured, for example as patch antennas, as described previously.

System 1000 is also shown to include an input/output (JO) system or controller 1050 which may be configured to enable or manage data communication between processor 1020 and other elements of system 1000 or other elements (not shown) external to system 1000. The system may generally present various interfaces to a user via a display element 204 such as, for example, a touch screen, liquid crystal display (LCD) or any other suitable display type. System 1000 is also shown to include a storage system 1070, for example a hard disk drive (HDD) or solid state drive (SSD), coupled to the processor 1020.

It will be appreciated that in some embodiments, the various components of the system 1000 may be combined in a system-on-a-chip (SoC) architecture. In some embodiments, the components may be hardware components, firmware components, software components or any suitable combination of hardware, firmware or software.

"Circuit" or "circuitry," as used in any embodiment herein, may comprise, for example, singly or in any combination, hardwired circuitry, programmable circuitry such as computer processors comprising one or more individual instruction processing cores, state machine circuitry, and/or firmware that stores instructions executed by programmable circuitry. The circuitry may include a processor and/or controller configured to execute one or more instructions to perform one or more operations described herein. The instructions may be embodied as, for example, an application, software, firmware, etc. configured to cause the circuitry to perform any of the aforementioned operations. Software may be embodied as a software package, code, instructions, instruction sets and/or data recorded on a computer-readable storage device. Software may be embodied or implemented to include any number of processes, and processes, in turn, may be embodied or implemented to include any number of threads, etc., in a hierarchical fashion. Firmware may be embodied as code, instructions or instruction sets and/or data that are hard-coded (e.g., non-volatile) in memory devices. The circuitry may, collectively or individually, be embodied as circuitry that forms part of a larger system, for example, an integrated circuit (IC), an application-specific integrated circuit (ASIC), a system on-chip (SoC), desktop computers, laptop computers, tablet computers, servers, smart phones, etc. Other embodiments may be implemented as software executed by a programmable control device. As described herein, various embodiments may be implemented using hardware elements, software elements, or any combination thereof. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth.

Any of the operations described herein may be implemented in one or more storage devices having stored thereon, individually or in combination, instructions that when executed by one or more processors perform one or more operations. Also, it is intended that the operations described herein may be performed individually or in any sub-combination. Thus, not all of the operations (for example, of any of the flow charts) need to be performed, and the present disclosure expressly intends that all sub-combinations of such operations are enabled as would be understood by one of ordinary skill in the art. Also, it is intended that operations described herein may be distributed across a plurality of physical devices, such as processing structures at more than one different physical location. The storage devices may include any type of tangible device, for example, any type of disk including hard disks, floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, Solid State Disks (SSDs), magnetic or optical cards, or any type of media suitable for storing electronic instructions.

Thus, the present disclosure provides systems, devices and methods for integration of millimeter wave antennas in platforms with reduced size form factors while maintaining or improving antenna gain. The following examples pertain to further embodiments.

According to Example 1 there is provided a millimeter wave antenna assembly. The system may include: a first planar substrate; a ground plane disposed on the first planar substrate; a second planar substrate disposed on the ground plane; an antenna radiation element disposed on the second planar substrate, the antenna radiation element to transmit a signal in the millimeter wave frequency region; a via to provide a conductive path for the signal from a microstrip feed line, beneath the first planar substrate, to the antenna radiation element; and a dielectric layer disposed on the antenna radiation element to provide increased antenna gain under conditions of reduced air gap between the antenna radiation element and a structural element of an enclosing platform.

Example 2 may include the subject matter of Example 1, and the dielectric layer includes a thickness in the range of 7 micrometers (um) to 90 um.

Example 3 may include the subject matter of Examples 1 and 2, and the dielectric layer includes a dielectric constant in the range of 1 to 8.

Example 4 may include the subject matter of Examples 1-3, and the reduced air gap is in the range of 0 millimeters (mm) to 0.2 mm.

Example 5 may include the subject matter of Examples 1-4, and the signal is in the frequency range of 56 gigahertz (GHz) to 64 GHz.

Example 6 may include the subject matter of Examples 1-5, and the increased antenna gain is in the range of 3.5 decibels (dB) to 5 dB.

Example 7 may include the subject matter of Examples 1-6, and the first and second planar substrates include a semiconductor material to provide mechanical structure to the antenna assembly and to provide a dielectric medium with a dielectric constant based on the frequency of the signal, a desired radiation pattern and the geometry of the antenna assembly.

According to Example 8 there is provided a method for fabrication of a millimeter wave antenna assembly. The method may include: disposing a ground plane on a first planar substrate; disposing a second planar substrate on the ground plane; disposing an antenna radiation element on the second planar substrate, the antenna radiation element to transmit a signal in the millimeter wave frequency region; inserting a via perpendicularly through the ground plane and the planar substrates, the via to provide a conductive path for the signal from a microstrip feed line, located beneath the first planar substrate, to the antenna radiation element; and disposing a dielectric layer on the antenna radiation element to provide increased antenna gain under conditions of reduced air gap between the antenna radiation element and a structural element of an enclosing platform.

Example 9 may include the subject matter of Example 8, and the dielectric layer includes a thickness in the range of 7 micrometers (um) to 90 um.

Example 10 may include the subject matter of Examples 8 and 9, and the dielectric layer includes a dielectric constant in the range of 1 to 8.

Example 11 may include the subject matter of Examples 8-10, and the reduced air gap is in the range of 0 millimeters (mm) to 0.2 mm.

Example 12 may include the subject matter of Examples 8-11, and the signal is in the frequency range of 56 gigahertz (GHz) to 64 GHz.

Example 13 may include the subject matter of Examples 8-12, and the increased antenna gain is in the range of 3.5 decibels (dB) to 5 dB.

Example 14 may include the subject matter of Examples 8-13, and the first and second planar substrates include a semiconductor material to provide mechanical structure to the antenna assembly and to provide a dielectric medium with a dielectric constant based on the frequency of the signal, a desired radiation pattern and the geometry of the antenna assembly.

According to Example 15 there is provided a platform. The platform may include: a processor; a wireless transmitter circuit coupled to the processor, the wireless transmitter circuit to receive a baseband signal for transmission and to convert the baseband signal to a millimeter wave signal; and a microstrip feedline to couple the wireless transmitter circuit to one or more antenna assemblies. The one or more antenna assemblies may include: a first planar substrate; a ground plane disposed on the first planar substrate; a second planar substrate disposed on the ground plane; an antenna radiation element disposed on the second planar substrate, the antenna radiation element to transmit the millimeter wave signal; a via to provide a conductive path for the millimeter wave signal from the microstrip feed line, located beneath the first planar substrate, to the antenna radiation element; and a dielectric layer disposed on the antenna radiation element to provide increased antenna gain under conditions of reduced air gap between the antenna radiation element and a structural element of the platform.

Example 16 may include the subject matter of Example 15, and the structural element of the platform is a case enclosure.

Example 17 may include the subject matter of Examples 15 and 16, and the dielectric layer includes a thickness in the range of 7 micrometers (um) to 90 um.

Example 18 may include the subject matter of Examples 15-17, and the dielectric layer includes a dielectric constant in the range of 1 to 8.

Example 19 may include the subject matter of Examples 15-18, and the reduced air gap is in the range of 0 millimeters (mm) to 0.2 mm.

Example 20 may include the subject matter of Examples 15-19, and the signal is in the frequency range of 56 gigahertz (GHz) to 64 GHz.

Example 21 may include the subject matter of Examples 15-20, and the increased antenna gain is in the range of 3.5 decibels (dB) to 5 dB.

Example 22 may include the subject matter of Examples 15-21, and the first and second planar substrates include a semiconductor material to provide mechanical structure to the antenna assembly and to provide a dielectric medium with a dielectric constant based on the frequency of the signal, a desired radiation pattern and the geometry of the antenna assembly.

According to Example 23 there is provided a system for fabrication of a millimeter wave antenna assembly. The system may include: means for disposing a ground plane on a first planar substrate; means for disposing a second planar substrate on the ground plane; means for disposing an antenna radiation element on the second planar substrate, the antenna radiation element to transmit a signal in the millimeter wave frequency region; means for inserting a via perpendicularly through the ground plane and the planar substrates, the via to provide a conductive path for the signal from a microstrip feed line, located beneath the first planar substrate, to the antenna radiation element; and means for disposing a dielectric layer on the antenna radiation element to provide increased antenna gain under conditions of reduced air gap between the antenna radiation element and a structural element of an enclosing platform.

Example 24 may include the subject matter of Example 23, and the dielectric layer includes a thickness in the range of 7 micrometers (um) to 90 um.

Example 25 may include the subject matter of Examples 23 and 24, and the dielectric layer includes a dielectric constant in the range of 1 to 8.

Example 26 may include the subject matter of Examples 23-25, and the reduced air gap is in the range of 0 millimeters (mm) to 0.2 mm.

Example 27 may include the subject matter of Examples 23-26, and the signal is in the frequency range of 56 gigahertz (GHz) to 64 GHz.

Example 28 may include the subject matter of Examples 23-27, and the increased antenna gain is in the range of 3.5 decibels (dB) to 5 dB.

Example 29 may include the subject matter of Examples 23-28, and the first and second planar substrates include a semiconductor material to provide mechanical structure to the antenna assembly and to provide a dielectric medium with a dielectric constant based on the frequency of the signal, a desired radiation pattern and the geometry of the antenna assembly.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

What is claimed is:

1. A millimeter wave antenna assembly comprising:

a first planar substrate;

a ground plane disposed on said first planar substrate;

a second planar substrate disposed on said ground plane;

an antenna radiation element disposed on said second planar substrate, said antenna radiation element to transmit a signal in a millimeter wave frequency region;

a via through said first planar substrate and through at least a portion of the second planar substrate, the via to provide a conductive path for said signal from a microstrip feed line to said antenna radiation element, said microstrip feed line disposed beneath said first planar substrate; and a dielectric layer disposed on said antenna radiation element to provide increased antenna gain under conditions of reduced air gap between said antenna radiation element and a structural element of an enclosing platform.

2. The antenna assembly of claim 1, wherein said dielectric layer comprises a thickness in the range of 7 micrometers (um) to 90 um.

3. The antenna assembly of claim 1, wherein said dielectric layer comprises a dielectric constant in the range of 1 to 8.

4. The antenna assembly of claim 1, wherein said reduced air gap is in the range of 0 millimeters (mm) to 0.2 mm.

5. The antenna assembly of claim 1, wherein said signal is in the frequency range of 56 gigahertz (GHz) to 64 GHz.

6. The antenna assembly of claim 1, wherein said increased antenna gain is in the range of 3.5 decibels (dB) to 5 dB.

7. The antenna assembly of claim 1, wherein said first and second planar substrates comprise a semiconductor material to provide mechanical structure to said antenna assembly and to provide a dielectric medium with a dielectric constant based on the frequency of said signal, a desired radiation pattern and a geometry of said antenna assembly.

8. A method for fabrication of a millimeter wave antenna assembly, said method comprising:

disposing a ground plane on a first planar substrate;

disposing a second planar substrate on said ground plane;

disposing an antenna radiation element on said second planar substrate, said antenna radiation element to transmit a signal in a millimeter wave frequency region;

inserting a via perpendicularly through said ground plane, said first planar substrate, and said second planar substrate, said via to provide a conductive path for said signal from a microstrip feed line, located beneath said first planar substrate, to said antenna radiation element; and disposing a dielectric layer on said antenna radiation element to provide increased antenna gain under conditions of reduced air gap between said antenna radiation element and a structural element of an enclosing platform.

9. The method of claim 8, wherein said dielectric layer comprises a thickness in the range of 7 micrometers (um) to 90 um.

10. The method of claim 8, wherein said dielectric layer comprises a dielectric constant in the range of 1 to 8.

11. The method of claim 8, wherein said reduced air gap is in the range of 0 millimeters (mm) to 0.2 mm.

12. The method of claim 8, wherein said signal is in the frequency range of 56 gigahertz (GHz) to 64 GHz.

13. The method of claim 8, wherein said increased antenna gain is in the range of 3.5 decibels (dB) to 5 dB.

14. The method of claim 8, wherein said first and second planar substrates comprise a semiconductor material to provide mechanical structure to said antenna assembly and to provide a dielectric medium with a dielectric constant based on the frequency of said signal, a desired radiation pattern and a geometry of said antenna assembly.

15. A platform comprising:

a processor;

a wireless transmitter circuit coupled to said processor, said wireless transmitter circuit to receive a baseband signal for transmission and to convert said baseband signal to a millimeter wave signal;

a microstrip feedline to couple said wireless transmitter circuit to one or more antenna assemblies; and said one or more antenna assemblies comprising:

a first planar substrate;

a ground plane disposed on said first planar substrate;

a second planar substrate disposed on said ground plane;

an antenna radiation element disposed on said second planar substrate, said antenna radiation element to transmit said millimeter wave signal;

a via through said first planar substrate and through at least a portion of the second planar substrate, the via to provide a conductive path for said millimeter wave signal from said microstrip feed line, located beneath said first planar substrate, to said antenna radiation element; and a dielectric layer disposed on said antenna radiation element to provide increased antenna gain under conditions of reduced air gap between said antenna radiation element and a structural element of said platform.

16. The platform of claim 15, wherein said structural element of said platform is a case enclosure.

17. The platform of claim 15, wherein said dielectric layer comprises a thickness in the range of 7 micrometers (um) to 90 um.

18. The platform of claim 15, wherein said dielectric layer comprises a dielectric constant in the range of 1 to 8.

19. The platform of claim 15, wherein said reduced air gap is in the range of 0 millimeters (mm) to 0.2 mm.

20. The platform of claim 15, wherein said signal is in the frequency range of 56 gigahertz (GHz) to 64 GHz.

* * * * *